United States Patent [19]

Dopp

[11] Patent Number: 4,706,995

[45] Date of Patent: Nov. 17, 1987

[54] BOOKMARK/WRITING INSTRUMENT COMBINATION

[76] Inventor: Kip H. Dopp, 108 Donielson Dr., Newcastle, Wyo. 82701

[21] Appl. No.: 895,330

[22] Filed: Aug. 11, 1986

[51] Int. Cl.[4] ..... B42D 9/00; G09F 3/00; G09F 9/00

[52] U.S. Cl. ..... 281/42; 281/30; 116/324; 40/334

[58] Field of Search ..... 281/42, 30; 116/35, 116/50, 234, 237, 307, 321, 323, 324; 40/334, 335; D19/35, 56

[56] References Cited

U.S. PATENT DOCUMENTS

| | | | |
|---|---|---|---|
| D. 201,734 | 7/1965 | Derensky | D19/36 |
| D. 248,864 | 8/1978 | Yen | D19/36 |
| 2,141,988 | 12/1938 | Kahn | 40/334 |
| 2,300,216 | 10/1942 | Grodsky et al. | 116/237 |
| 2,383,858 | 8/1945 | Harris | 281/30 |
| 3,137,269 | 6/1964 | Sager | 116/237 |
| 4,162,800 | 7/1979 | Gonot, Jr. | 116/234 |
| 4,208,984 | 6/1980 | Glanzman | 116/324 |
| 4,243,338 | 1/1981 | Williams | 40/334 |
| 4,508,464 | 4/1985 | Money | 40/334 |

*Primary Examiner*—Paul A. Bell
*Assistant Examiner*—Paul M. Heyrana

[57] ABSTRACT

A bookmark/writing instrument includes a thin, generally planar card made of a flexible material, and having a cutout section formed therein for receiving and holding a writing instrument. The writing instrument is made of athin generally planar piece of material dimensioned to fit within the cut-out section of the card in a co-planar relationship therewith. Structure is included for releasably holding the piece of material in place within the cut-out section of the card. A marking device is disposed on the piece of material to enable writing on or otherwise marking an object. At least one side edge of the card is substantially straight to provide a straight edge for marking.

15 Claims, 7 Drawing Figures

BOOKMARK/WRITING INSTRUMENT COMBINATION

BACKGROUND OF THE INVENTION

This invention relates to a combination bookmark and writing instrument having a generally flat profile to enable placement thereof between leaves of a book.

Underlining or marking in books is done when it is desired to later quickly find a certain passage or sentence. Because of the need to occasionally mark books, a number of proposals have been offered for holding or attaching pencils or writing instruments to books. See, for example, J. C. Matson, U.S. Pat. No. 2,066,992, and Fred P. Gonot, Jr., et al, U.S. Pat. No. 4,162,800. The first mentioned reference discloses a holder for pencils which is placed upon the hinge of a book; the last mentioned reference discloses a combination bookmark and pencil holder consisting of a flexible strap which may be looped about the leaves of a book to mark a page in the book and also to hold a pencil or pen on the outside of the book cover.

Occasionally, a person reading a book may attempt to mark a location in the book by leaving a pencil or pen between the desired pages. This can be done by simply leaving the pencil or pen loose between the pages or by using a pocket clip attachment of the pencil or pen to clip the pencil or pen to one or more of the leaves of the book. In both instances, closure of the book puts a stress on the book hinge and can ultimately damage the hinge and the book.

SUMMARY OF THE INVENTION

It is an object of the invention to provide a combination bookmark/writing instrument which may be used to both designate a specific location in a book and mark or underline portions of the book, all without causing damage in any way to the book or the book hinge.

It is also an object of the invention to provide such a combination bookmark/writing instrument which may easily fit between the pages of a book without causing a bulge or otherwise deforming the book.

It is a further object of the invention to provide such a combination bookmark/writing instrument which is simple in design and economical to construct.

It is an additional object of the invention to provide such a bookmark/writing instrument which provides a straight edge by which straight line markings may be made by the writing instrument portion of the combination.

The above and other objects of the invention are realized in a specific illustrative embodiment of a bookmark/writing instrument which includes a thin, generally planar card made of a flexible material and having a cut-out section formed therein for receiving and holding a writing instrument. A writing instrument is also provided where the instrument includes a thin generally planar piece of material dimensioned to fit within the cut-out section of the card in a co-planar relationship therewith, structure for releasably holding the piece of material in place within the cut-out section of the card, and a marking device disposed on the piece of material to enable writing on or otherwise marking an object.

In accordance with one aspect of the invention, at least one side edge of the card is substantially straight to provide a straight edge for marking.

BRIEF DESCRIPTION OF THE DRAWINGS

The above and other objects, features and advantages of the invention will become apparent from a consideration of the following detailed description presented in connection with the accommanying drawings in which.

DETAILED DESCRIPTION

Figure 1:
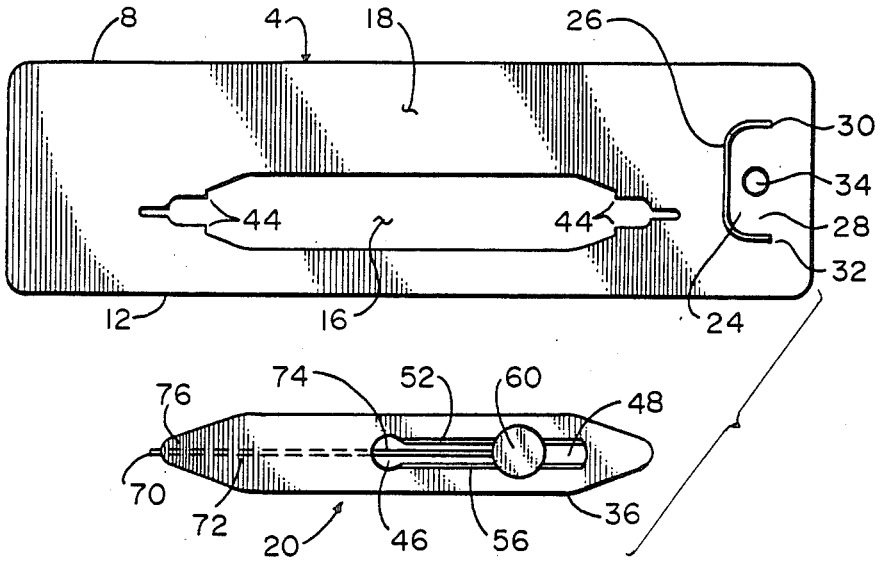
FIG. 1 shows a side view of a bookmark/writing instrument combination made in accordance with the principles of the present invention in which the writing instrument is removed from the bookmark portion of the combination.
Figure 2:
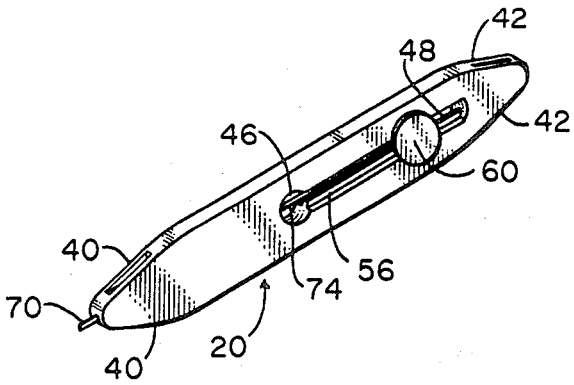
FIG. 2 shows a perspective view of the writing instrument portion of the combination.
Figure 3:
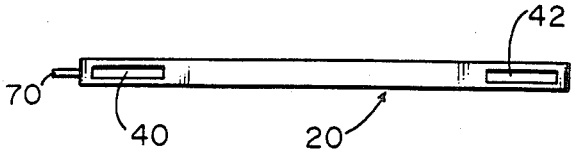
FIG. 3 shows an edge view of the writing instrument.
Figure 4:
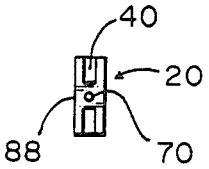
FIG. 4 shows a front end view of the writing instrument.

Referring to FIGS. 1–4, there is shown one embodiment of a bookmark/writing instrument combination which includes a thin, generally planar and elongate card 4 made of a flexible and resilient material such as plastic. The card 4 is generally rectangular, as shown, with the two long sides 8 and 12 of the card being substantially straight. An elongate cut-out section 16 is formed in the card 4 near the long side edge 12. This cut-out section is shaped and dimensioned to receive and hold an elongate writing instrument 20 to be discussed momentarily. A relatively large area 18 of the card 4 remains for use in advertising, placement of instructions, or other visual material.

Formed at one end of the card 4 is a tab 24 cut from the card to have a free end 26, which may be pivoted out from the plane of the card, and a fixed end 28 integrally formed with the card. The tab is formed by making a channel cut beginning at a point 30 and extending in the longitudinal direction a short distance, then extending laterally for a longer distance, and finally extending back longitudinally in the other direction to a point 32. The purpose of the tab 24 is to enable placement of the card 4 flat against the page of a book, pivoting the tab outwardly and over an edge of the page to secure the card in place, similar to a pocket clip of a pen or pencil.

A generally circular hole or opening 34 is formed in the tab 24 to enable making a circle around numbers, letters or the like of material being read by the user.

As indicated earlier, the card 4 is made of a thin, generally flat material and for example would have a thickness of about twenty thousandths of an inch. The writing instrument 20 is likewise made of a thin, generally flat piece of material which, for example, might have a thickness of about three times that of the card. The writing instrument 20 is made of a single piece of elongate material 36 dimensioned for placement in the cut-out section 16 of the card 4.

As will be seen in FIG. 1, the cut-out section 16 is generally symmetrical both about a line extending longitudinally through the center of the cut-out section and a line extending laterally through the center of the cut-out section. The writing instrument 20 is likewise generally symmetrical about a center line extending longitudinally through the center of the instrument and about a line extending laterally through the center of the instrument. This enables placement of the writing instrument 20 in the cut-out section 16 of the card 4 with either side facing outwardly and with either end of the writing instrument placed in either end of the cut-out section 16.

The perimeters of the front and rear ends of the writing instrument 20 are formed with channels 40 and 42 respectively. The width of these channels is substantially the same as or just greater than the thickness of the card 4 so that when the writing instrument 20 is placed in the cut-out section 16, tabs 44 formed at the card edge of the cut-out section may be received within the channels. These tabs 44, as shown, are formed on both sides of the cut-out section 16 and at both ends thereof to securely hold the writing instrument 20 in place when it is inserted in the cut-out section. Because the card 4 is made of a flexible and resilient material, the tabs 44 may be bent or pushed aside when inserting the writing instrument 20 in place, to thereafter "spring" back into the channel 40 of the writing instrument when the writing instrument is in proper position.

Figure 6:
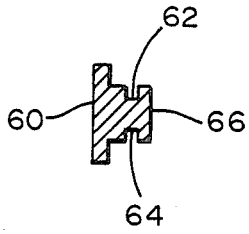
FIG. 6 shows a rear end view of the slider element.

The piece of material 36 of the writing instrument 20 is formed with an elongate slot 48. Two side rails 52 and 56 are formed of the material 36 to project inwardly towards one another in the slot 48 and to extend from the rear of the slot 48 to locations just short of the front end of the slot to leave an opening 50 defined at the front end. The side rails 52 and 56 are thinner than the rest of the material 36 and are arranged to be generally parallel with one another. Positioned in the slot 48 to slide longitudinally between the side rails 52 and 56 is a generally circular slider element 60. The slider element 60 is formed with channels 62 and 64 positioned on the top and bottom respectively of the element to receive the side rails 52 and 56 (see FIG. 6). When the slider element 60 is moved longitudinally in the slot 48, the side rails 52 and 56, being disposed in the channel 62 and 64 of the element, serve to guide and hold the element in place. One side 66 of the slider element 60 has a smaller diameter than the other side 68, and than the opening 50, to enable insertion of the side 66 through the opening 50 and placement of the element between the side rails 52 and 56. Provision of the larger side 68 of the slider element 60 facilitates easy grasping of the element to move the element.

A cylindrical tube 70 is disposed in a bore 72 which is formed in the piece of material 36 to extend from a forward end of the writing instrument 20 to the slot 48. The tube 70 protrudes a short distance from the end of the writing instrument 20 and extends a short distance into the bore 72. A plunger rod 74 is provided, with one end being inserted within the bore 72 and the other end molded into the slider element 60.

To use the writing instrument 20, a piece of conventional lead or similar writing material is placed in the bore 72 and tube 70 to protrude a certain distance out the end of the tube as with a conventional mechanical pencil. The bore 72 is made narrower at location 72 than at the remainder of the bore to provide friction on the lead inserted therein and prevent it from simply falling out of the bore. As the writing instrument 20 is used and the lead is worn down, the slider element 60 may be moved forwardly to force the plunger rod 74 forwardly within the bore 72. The plunger rod 74 thus forces the lead disposed within the bore 72 forwardly thereof. In this manner, more lead is made available to continue writing or marking.

Figure 5:
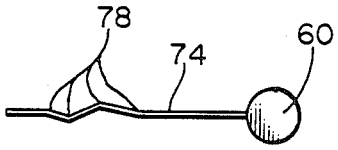
FIG. 5 shows a side view of the plunger rod and slider element of the writing instrument.

The plunger rod 72 includes several successively positioned bends 78 (exaggerated in FIG. 5) so that the rod contacts the side walls of the bore 72 to develop resistance to movement of the rod. Thus, when the writing instrument is being used, the plunger rod 74 will resist backward movement of the lead caused by pressing the lead against writing material.

Advantageously, the tube 70 would be made of a material such as stainless steel tubing, with a central bore 88 (FIG. 4) about the same as or just slightly larger than the diameter of writing lead to be used in the tube.

In the manner described, a generally flat bookmarker 4, with substantially straight long edges is provided. The bookmarker includes a cut-out section 16 for receiving and holding a similarly thin, flat writing instrument 20. When the bookmarker and writing instrument combination is placed between the leaves of a book, no damage is caused to the hinge of the book. The writing instrument 20, being held in the bookmark, is always available for writing or marking.

Figure 7:
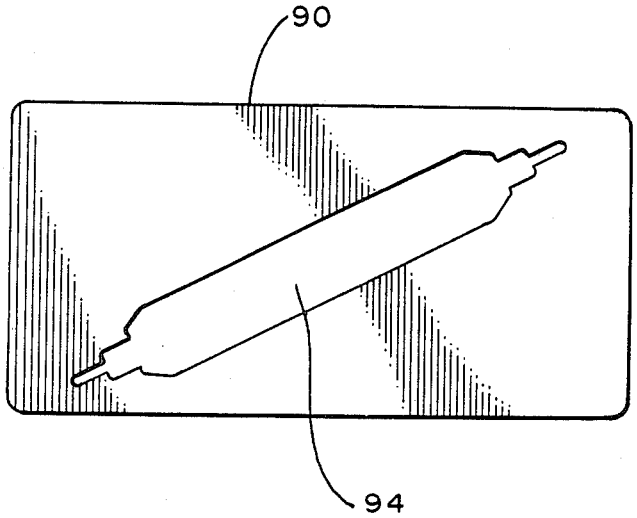
FIG. 7 shows a side view of an alternative embodiment of the bookmark portion of the combination of the present invention.

An alternative embodiment of the present invention is shown in FIG. 7 to include a credit-card or business card size sheet of material 90 having a generally rectangular shape. A cut-out section 94 is formed diagonally in the sheet of material to receive and hold a writing instrument similar to writing instrument 20 shown in FIGS. 1 through 4. The embodiment of FIG. 7 could be kept with other credit or business cards in a credit or business card holder to provide a readily available writing instrument.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A bookmark/writing instrument combination comprising a thin, generally planar card made of a flexible material and having a cut-out section formed therein for receiving and holding a writing instrument, and a writing instrument including a thin, generally planar piece of material dimensioned to fit within the cut-out section of said card in a co-planar relationship therewith, means for releasably holding the piece of material in place within the cut-out section of the card, and marking means disposed on the piece of material to enable writing on or otherwise marking an object.

2. A combination as in claim 1 wherein at least one side edge of said card is substantially straight.

3. A combination as in claim 2 wherein said card is generally rectangular in shape.

4. A combination as in claim 3 wherein the cut-out section is generally elongate and arranged to extend diagonally in the card.

5. A combination as in claim 1 wherein said card is made of a resilient material and includes a tab cut from the card to have a free end which may be pivoted out of the plane of the card, and a fixed end integrally formed with the remainder of the card.

6. A combination as in claim 1 further including a generally circular opening formed in said card near an edge thereof.

7. A combination as in claim 1 wherein said holding means comprises a channel formed in at least a portion of the perimeter of the piece of material to face laterally thereof for receiving the card edge of the cut-out section when the piece of material is placed within the section.

8. A combination as in claim 7 further including tabs formed integrally with the card on the card edge of the cutout section to project into the section to be received within the channel of the piece of material when the piece of material is placed within the section.

9. A combination as in claim 8 wherein said card is made of a resilient material.

10. A combination is in claim 1 wherein said piece of material is generally elongate and flat, having a forward end and a rearward end, and includes a slot formed centrally therein to extend along a portion of the length of the material, and wherein said marking means includes a slider element disposed to slide forwardly and rearwardly in said slot, a bore formed in the piece of material to extend between the slot and the forward end of the material for holding an elongate piece of lead or the like, and a plunger rod, one end of which is coupled to the slider element and other end of which is disposed in said bore to move longitudinally therein as the slider element is moved.

11. A combination as in claim 10 wherein said piece of material further includes a pair of rails formed on the side edges of the slot to project inwardly towards one another, and wherein said slider element is formed with a pair of laterally facing channels into which are received respective rails along which the slider element is adapted to slide.

12. A combinations in claim 10 wherein said plunger rod includes a series of bends such that the rod is caused to contact the sidewalls of the bore to resist being moved therein.

13. A combination as in claim 10 further including a tube fitted into a forward portion of said bore to project out of the bore beyond the forward end of the material for receiving and guiding a piece of lead inserted into the bore.

14. A combination as in claim 1 wherein said cut-out section is generally elongate and symmetrical about the center point thereof, and wherein the piece of material is also generally elongate and symmetrical about the center point thereof so that the piece of material may fit within the cut-out section.

15. A combination as in claim 1 wherein said card includes an area on which may be placed visual material.

* * * * *